US006298916B1

(12) United States Patent
Tibbles et al.

(10) Patent No.: US 6,298,916 B1
(45) Date of Patent: Oct. 9, 2001

(54) METHOD AND APPARATUS FOR CONTROLLING FLUID FLOW IN CONDUITS

(75) Inventors: Raymond J. Tibbles, Missouri City; James A. Pramann, II, Sugar Land; Stephen L. Jackson, Richmond; David R. Mandeville, Sugar Land, all of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/466,386

(22) Filed: Dec. 17, 1999

(51) Int. Cl.[7] ..... E21B 43/04

(52) U.S. Cl. ..... 166/278; 166/375; 166/145; 166/149; 166/183

(58) Field of Search ..... 166/373–375, 166/386, 278, 129, 142, 145, 149, 183

(56) References Cited

U.S. PATENT DOCUMENTS 3,288,221 * 11/1966 Howard et al. .
3,552,486 * 1/1971 Burns .
4,407,363 * 10/1983 Akkerman .
5,161,613 11/1992 Jones .
5,390,966 2/1995 Cox et al. .
5,419,394 5/1995 Jones .
5,515,915 5/1996 Jones et al. .
5,588,487 12/1996 Bryant .
5,622,224 4/1997 Yates .
5,730,223 3/1998 Restarick .
5,829,525 * 11/1998 Dobson et al. .
5,868,200 2/1999 Bryant et al. .

* cited by examiner

*Primary Examiner*—Roger Schoeppel
(74) *Attorney, Agent, or Firm*—Trop Pruner & Hu P.C.

(57) ABSTRACT

A completion string for use in a wellbore includes a main conduit, such as a production tubing, and one or more alternate path conduits, such as shunt tubes, that extend generally in parallel with the main conduit. A flow control device is positioned in each alternate path conduit to control flow through the alternate path conduit. The one or more alternate path conduits may be adapted to carry gravel slurry to perform gravel packing operations. The one or more flow control devices in the one or more alternate path conduits may be actuated to the open position to allow communication of the gravel slurry to multiple zones in the wellbore. Once the gravel packing operation is completed, the one or more flow control devices may be actuated to the closed position to block fluid flow communication between multiple zones through the alternate path conduits during operation of the well. Other types of fluids may be communicated through the one or more alternate path conduits, such as fracturing fluids.

47 Claims, 10 Drawing Sheets

METHOD AND APPARATUS FOR CONTROLLING FLUID FLOW IN CONDUITS

BACKGROUND

The invention relates to controlling fluid flow in conduits such as shunt tubes or other types of alternate conduits.

To complete a well, one or more formation zones adjacent the wellbore are perforated to allow fluid from the formation zones to flow into the well for production to the surface. Perforations are typically created by perforating gun strings that are lowered to desired intervals in the wellbore. When fired, perforating guns extend perforations into the surrounding formation.

In producing fluids from a formation, particulate materials such as sand may be produced with the formation fluids. Such particulates may damage the well and significantly reduce production and life of the well. Formation fluids containing particulates may act as an abrasive that wears and erodes downhole components, such as tubing. In addition, production of particulates such as sand may create voids in the formation behind the casing which may result in buckling of or other damage to the casing. The flow of the production fluids may be insufficient to lift the particulates from the well, which may result in buildup of the particulates in the well. In addition, particulates produced to the surface are waste products requiring disposal, which may be costly.

Various methods and devices for reducing or eliminating sand and other particulate production have been developed. Gravel packing of the formation is a popular method for controlling sand production. However, other sand control mechanisms may also be used. Although there are variations, gravel packing essentially involves placing a sand screen around the section of the production string containing the production inlets. This section of the production string is aligned with the perforations. A slurry of gravel in a viscous transport fluid is pumped into the annulus between the sand screen and the casing. The deposited gravel blocks the formation particulates, such as sand, from flowing into the production tubing. However, formation fluids are allowed to enter the production string for flow to the well surface.

A major issue associated with gravel packing is obtaining substantially uniform distribution of the gravel over the entire interval to be completed. Poor distribution of gravel is often caused by the loss of liquid from the gravel slurry into the more permeable portions of the formation, which causes creation of gravel "bridges" in the annulus before all of the gravel has been placed. These bridges block further flow of the slurry through the annulus to prevent or reduce distribution of gravel past the bridge.

To alleviate the problem of bridging in gravel packing, shunt tubes have been used as alternate paths through which the gravel slurry can flow. Thus, if a sand bridge forms in the annulus, the slurry is still free to flow through the shunt tubes and out into the annulus through ports in the shunt tubes to complete the filling of the annulus past the sand bridge.

The shunt tubes may extend through a plurality of completion zones. As the annular region in each of the zones fill up with gravel, a point of "sand out" is reached in which further injection of gravel is prevented. At this point, any excess sand or other particulates in the production string may be circulated to the well surface. The well is then ready for production. However, the shunt tubes may remain in communication with multiple zones, which may cause commingling of formation fluids between zones. Such commingling of formation fluids is undesirable. Thus, a need exists for a method and apparatus to block communication of fluids between different zones through shunt tubes or other alternate conduits during production.

SUMMARY

In general, according to one embodiment, an apparatus for use in a wellbore includes a main conduit, a second conduit, and a flow control device positioned in the second conduit to control flow through the second conduit.

Other features and embodiments will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Figure 1:
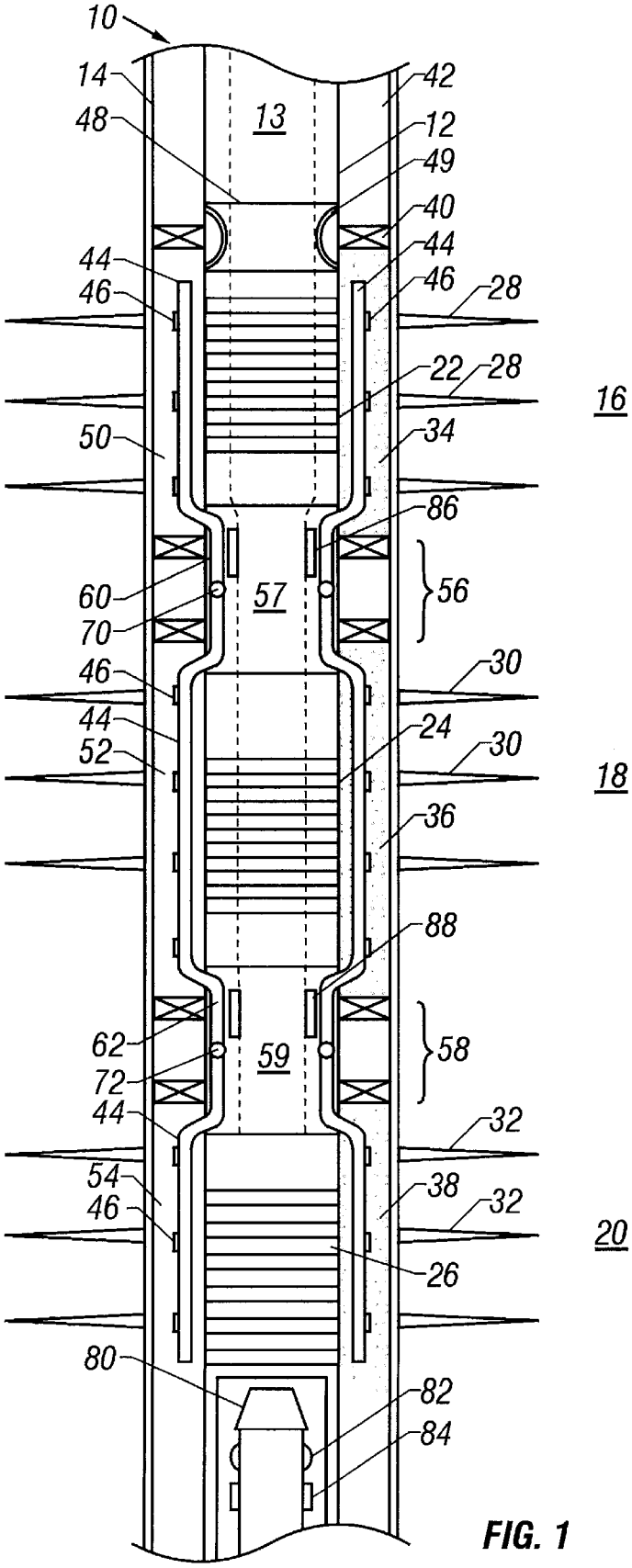
FIG. 1 illustrates an embodiment of completion equipment positioned in a wellbore having a plurality of completion zones.

Referring to FIG. 1, completion equipment including casing 14, a production tubing 12, and other components are positioned in a wellbore 10 having a plurality of zones 16, 18, and 20. In further embodiments, a larger or a smaller number of zones may be present in the wellbore 10. Sand control devices 22, 24 and 26 may be positioned in the proximity of the zones 16, 18 and 20, respectively, to control production of sand and other particulates into the tubing 12 through perforations 28, 30 and 32 in the zones 16, 18 and 20, respectively. Each of the sand control assemblies 22, 24 and 26 includes a screen having perforations through which well fluids may flow. Gravel packs 34, 36 and 38 may be formed in annular regions in the proximity of the zones 16, 18 and 20, respectively.

To form the gravel packs, a gravel slurry may be pumped down an upper annular region 42 between the outside of the production tubing 12 and the inner wall of the casing 14 above a packer assembly 40. A crossover device 48 may be part of the packer assembly 40 to allow the gravel slurry to flow past the packer assembly 40 into a first annular region 50 adjacent the first zone 16. One or more shunt tubes 44 may be present in the annular region 50. The shunt tubes 44 start near the upper part of the annular region 50 and extend down the completion string to the lower annular regions 52 and 54 that are adjacent zones 18 and 20, respectively. The shunt tubes 44 include ports 46 placed at intervals along the length of the shunt tubes 44 to allow communication between the inside and the outside of the shunt tubes 44.

A packer assembly 56, which may include a cup packer or other type of packer, is positioned between the first annular region 50 and the second annular region 52. A second packer assembly 58 is positioned between the second annular region 52 and the third annular region 54. The packer assemblies 56 and 58 provide the isolation between the three zones 16, 18, and 20.

The shunt tubes 44 are attached to the packer assemblies 56 and 58. Each of the packer assemblies 56 and 58 includes internal side or alternative conduits 60 and 62, respectively, that are attached to and in fluid communication with the shunt tubes 44. The shunt tubes 44 and the conduits 60 and 62 in the packer assemblies 56 and 58 are adapted to receive gravel slurry that is injected or pumped into the wellbore 10. Each of the packer assemblies 56 and 58 also includes a main conduit 57 or 59 that is in communication with the production tubing 12. As used here, the term "alternate path conduit" is intended to cover any fluid flow path that is separate from a main production or injection conduit 13. The alternate path conduit may refer to a conduit in one or more completion components, such as the packer assembly 56 or 58; a conduit run outside completion equipment, such as a shunt tube; or a combination of conduits that are outside and inside completion components.

In accordance with some embodiments of the invention, flow control devices 70 are placed in the side conduits 60 of the packer assembly 56, and flow control devices 72 are placed in the side conduits 62 of the packer assembly 58. Although plural shunt tubes 44 and conduits 60 and 62 are illustrated, further embodiments may include only a single shunt tube 44 and a single conduit 60 or 62.

In one embodiment, to actuate the flow control devices 70 and 72, a service tool 80 may be used. The service tool 80 may have been positioned initially in the tubing 12 below the third zone 20. The service tool 80 includes seals 82 to seal the lower portion of the production tubing 12 so that fluid does not flow up the tubing 12 from below the service tool 80. In accordance with some embodiments, the service tool 80 includes a latch profile 84 adapted to engage flow control device actuators 86 and 88 in the packer assemblies 56 and 58, respectively. In one embodiment, activation of the actuator 86 or 88 may be performed by upward movement of the service tool 80 after gravel packing has been completed. In the illustrated embodiment, the operator to actuate the flow control device 70 and 72 is part of the service tool 80. In other embodiments, the flow control device operator may be in another tool.

In operation, gravel slurry is pumped down the upper annular region 42 and communicated through conduits 49 in the crossover device 48 to the first annular region 50. In the example given, the first, second, and third annular regions 50, 52, and 54 are filled in that order. However, in other examples, the order in filling up the several regions may be varied. As the annular region 50 fills up or is blocked by bridging, further flow of gravel slurry is provided through the shunt tubes 44 to exit through ports 46 to lower portions of the annular region 50. Once the annular region 50 is filled, the gravel slurry flows through the side conduits 60 in the packer assembly 56 to the shunt tube portions 44 in the second annular region 52. The gravel slurry enters the annular region 52 through exit ports 46 of the shunt tubes 44 to fill the annular region 52 with gravel. Next, the gravel slurry flows further down the shunt tubes 44 and through the side conduits 62 into the third annular region 54 to fill the region 54 with gravel. Once the annular regions 50, 52 and 54 have completely filled with gravel, a condition referred to as "sand out" occurs, in which further pumping of gravel slurry into the annular regions is not possible. This condition is determined by the well operator based on a reduced injection rate of the gravel slurry, a comparison of the volume of gravel slurry pumped into the well and the expected volume based on tests of the formation, and a pressure increase.

In some arrangements, the shunt tubes or other alternate conduits may also be used to flow fracturing fluid to perform fracturing operations. Fracturing of a formation is performed to stimulate the formation to improve production of fluids. Generally, fracturing involves the injection of fluid under high pressure into the perforated formation to create or extend fractures in the hydrocarbon bearing formation. Typically, fracturing is performed before gravel packing operations.

To prevent commingling of fluids after sand out has occurred, flow control devices 70 and 72 may be actuated from an open position to a closed position. In the described example, the flow control devices are assumed to be both initially open. However, in other examples, one or more flow control devices in shunt tubes may be initially closed and opened at a later time. As used here, a closed position does not necessarily mean complete blockage of fluid flow. Rather, some acceptable fluid leakage may occur through the flow control devices 70 and 72 even though they are in the closed position. For example, such leakage may be about six percent or less of the fluid flow when the flow control devices 70 and 72 are fully open. When actuated to the closed positions, further flow in the shunt tubes 44 are blocked, thus preventing commingling of fluids between annular regions 50, 52 and 54. If desired, the flow control devices 70 and 72 may be actuated open again from the closed position.

Commingling of fluids between zones may have various undesirable effects. Introduction of contaminants from one zone to another may occur. Mixing some types of contaminants may produce chemical reactions that may produce solids to plug a formation. Also, with inter-zone communication through the shunt tubes, separate testing of each zone may not be possible.

After sand out occurs, any accumulated sand or other particulates in the production string are circulated to the well surface. Next, the service tool 80 may be raised to engage the lower flow control device actuator 88 in the packer assembly 58 to close the flow control device 72. After the flow control device 72 has been closed, the service tool 80 can be raised further to engage the flow control device actuator 86 in the packer assembly 56. Upward movement of the service tool 80 closes the flow control device 70. With both flow control devices 70 and 72 in the closed position, commingling of fluids through the shunt tubes 44 is eliminated or reduced.

After the flow control devices 70 and 72 are closed, the service tool 80 can be retrieved to the surface. Other types of flow control device operators may also be used. In another embodiment, instead of using a mechanical actuating mechanism that is part of the service tool 80 to actuate the flow control devices 70 and 72, hydraulic control lines may be run from the surface to each of the packer assemblies 56 and 58. Pistons may be provided in the actuators 86 and 88 to allow hydraulic actuation of the flow control devices 70 and 72.

In another embodiment, electrical activation of the actuators 86 and 88 may be possible. Electrical lines may be run through control lines to the packer assemblies 56 and 58. Power and signaling can then be provided down the electrical lines to control activation of the actuators 86 and 88. In yet another embodiment, instead of using electrical lines, inductive couplers may be used to activate the actuators 86 and 88. If inductive coupling is used, a first inductive coupler portion may be positioned in each packer assembly 56 or 58 and a second inductive coupler portion may be located inside a tool that may be run into the production tubing 12. For example, the second inductive coupler portion may be located in the service tool 80. To activate the actuator 86 or 88 using the inductive coupler mechanism, the service tool 80 (or some other tool run in the tubing 12) may be moved into proximal relation with the first inductive coupler portion in the packer assembly 56 or 58. An electrical signal can then be transmitted down electrical wires, such as wires inside a wireline, to the service tool 80, with the electrical energy coupled from the second inductive coupler portion to the first inductive coupler portion to activate the actuator 86 or 88. Other mechanisms for activating the actuators 86 and 88 may also be possible in further embodiments.

Figure 5A:
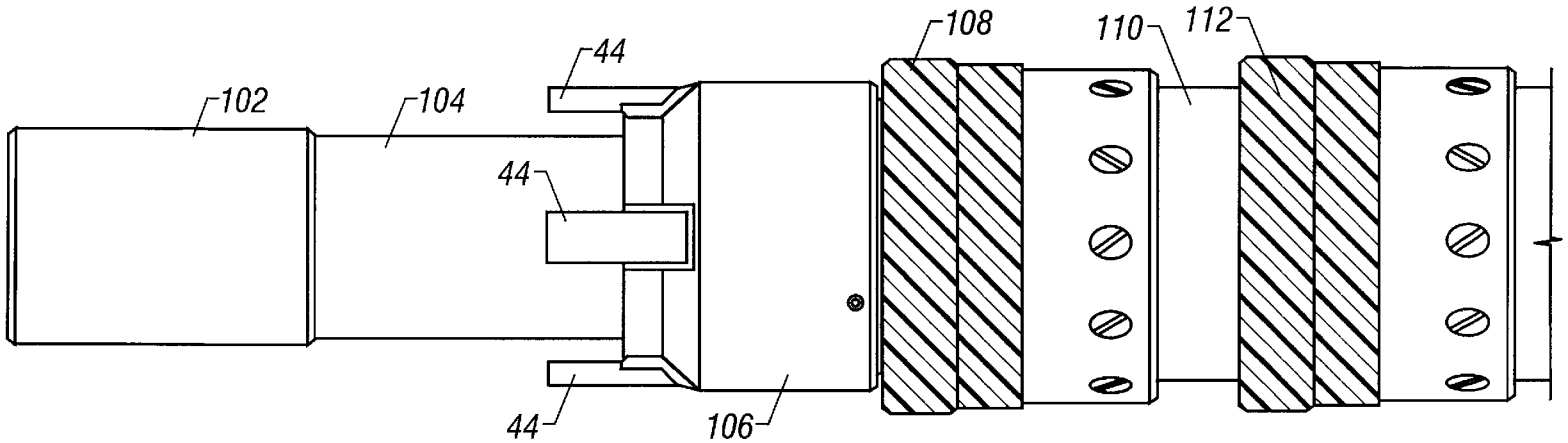
FIGS. 5A–5C are a side view of the packer assembly of FIGS. 2A–2C with a portion of the outer housing cut out to show a portion of a flow control device actuator.

Referring to FIGS. 2A–2C and 5A–5C, the packer assembly 56 or 58 according to one embodiment is illustrated in greater detail. The packer assembly 56 or 58 includes an inner bore 100 that is in communication with the inner bore of the production tubing 12. A coupling adapter 102 connects a mandrel 104 in the packer assembly to the production tubing 12 above the packer assembly 56 or 58. The mandrel 104 divides the inner bore 100 from the alternate or side conduits 60 or 62 in the packer assembly 56 or 58, respectively. A shunt locator mechanism 106 connects the shunt tubes 44 to the side conduit 60 or 62. Thus, as indicated by the arrows, the flow of gravel slurry in the shunt tube 44 flows into the side conduit 60 or 62. As illustrated in FIG. 5A, a plurality of shunt tubes 44 are provided in one embodiment, with each shunt tube 44 in communication with a corresponding side conduit 60 or 62. Casing cup packers 108 and 112 are attached to a cup support housing 110. The casing cups 108 and 112 are in contact with the inner wall of the casing 14 to provide a seal around the outside of the cup packer assembly 56 or 58. In another embodiment, other types of packers may be employed.

Figure 2A:
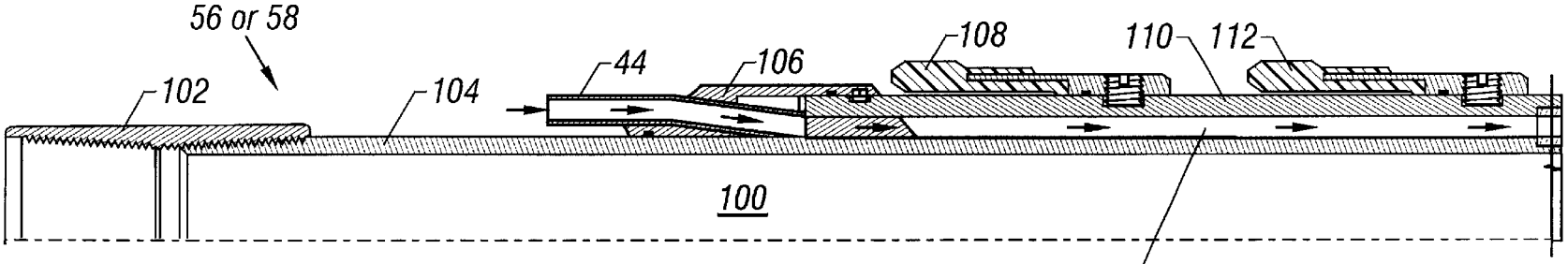
FIGS. 2A–2C, 3A–3C, and 4A–4C are cross-sectional views of a packer assembly in accordance with one embodiment in three different positions, the packer assembly including a side conduit and a flow control device in the side conduit.
Figure 2B:
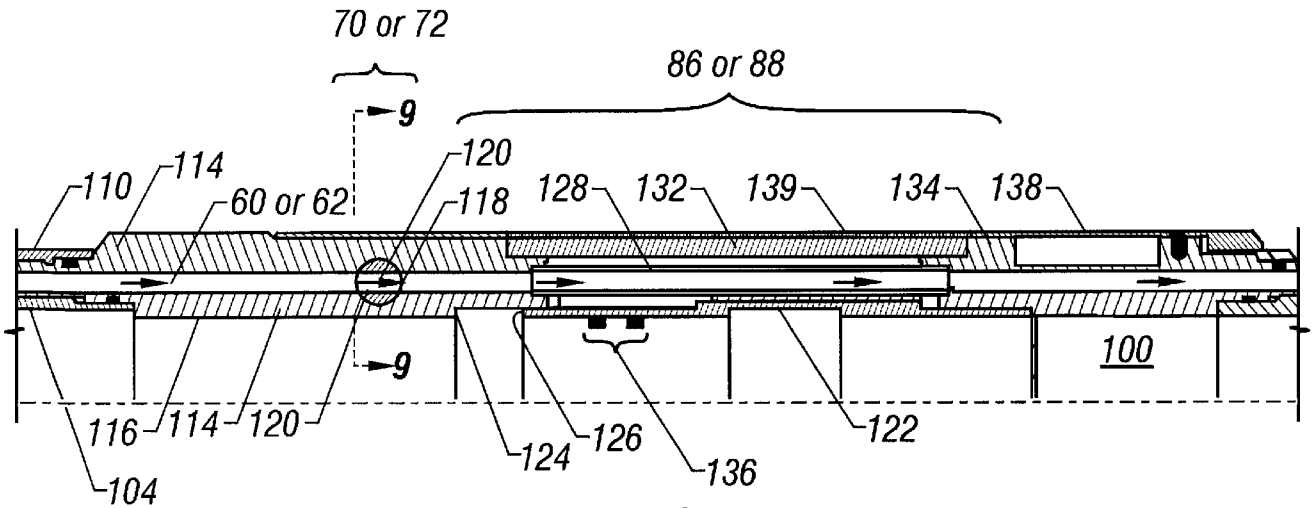
Figure 5B:
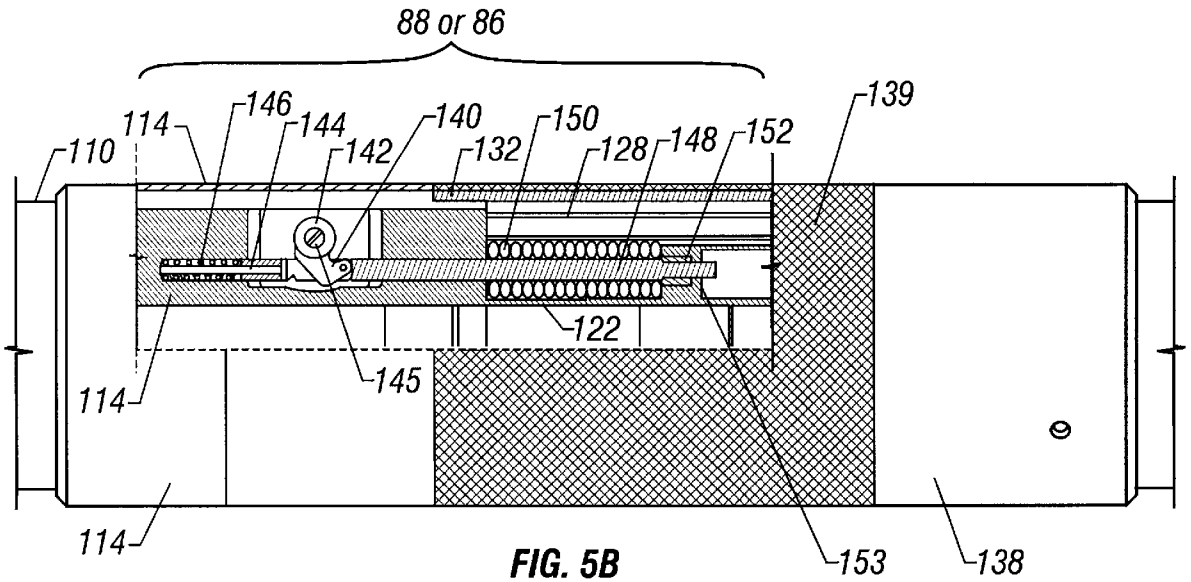
Figure 5C:
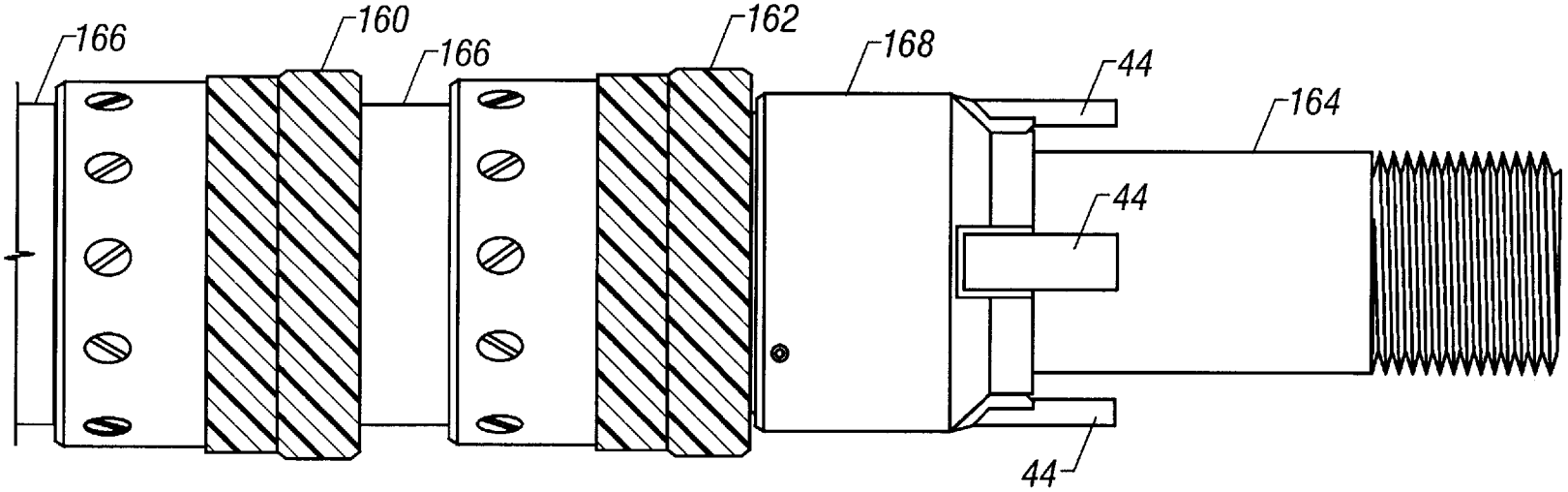

The lower ends of the cup support housing 110 and mandrel 104 are connected to a valve housing 114 (FIGS. 2B and 5B). As shown in FIG. 2B, the valve housing houses a barrel valve 118 that is part of the flow control device 70 or 72. In FIG. 2B, the barrel valve 118 is shown in its open position. The barrel valve 118 includes an inner conduit 120 that when open is aligned with the side conduit 60 or 62.

A shunt 128 and another housing section 132 are connected below the valve housing 114. A sub 134 is attached to the lower end of the shunt 128. Each side conduit 60 or 62 extends through bores in the shunt 128 and the sub 134.

In addition, an actuator sleeve 122 is arranged inside the valve housing 114, shunt 128, and sub 134. The actuator sleeve 122 is adapted to move longitudinally or axially in the inner bore 100 of the packer assembly 56 or 58. The actuator sleeve 122 is shown in its initial, un-actuated position. The actuator sleeve 122 can move upwardly until an upper end 126 of the sleeve 122 abuts a shoulder 124 formed in the inner wall of the valve housing 114. An engagement profile 136 is provided in the inner wall of the actuator sleeve 122 to engage a valve operator (e.g., such as one in the service tool 80), to move the actuator sleeve 122 up and down to actuate the barrel valve 118. An outer sleeve 138 surrounding the sub 134 is connected to the sub 134. In one embodiment, a portion 139 of the outer sleeve 138 may be in the form of a screen.

In FIG. SB, an outer section of the valve housing 114 is cut out to show a further portion of the actuator 86 or 88 that is at a different phase with respect to the portion shown in FIG. 2B. A rotatable actuating ring 142 is coupled to the barrel valve 118 by a ratchet mechanism, shown in FIGS. 12 and 13. The actuating ring 142 is rotatable by a control arm 140 having an end in abutment with an upper surface of a rod member 148. The control arm 140 when actuated upwardly comes in contact with a lower surface of a control rod 144. The rod member 148 is moveable longitudinally by the actuator sleeve 122 to push upwardly against the control arm 140 to rotate the actuating ring 142. Movement of the control arm 140 pushes the control rod 144 up against a spring 146. If the rod member 148 is moved upwardly to rotate the actuating ring 142, the barrel valve 118 is rotated to the next position (that is, from open to closed or closed to open).

Another spring 150 is arranged around a lower part of the rod member 148. The spring 150 sits on an extension 153 of the actuator sleeve 122. The extension 153 is attached to the rod member 148 by a nut 152. Upward movement of the rod member 148 by the actuator sleeve 122 also compresses the spring 150.

Figure 2C:
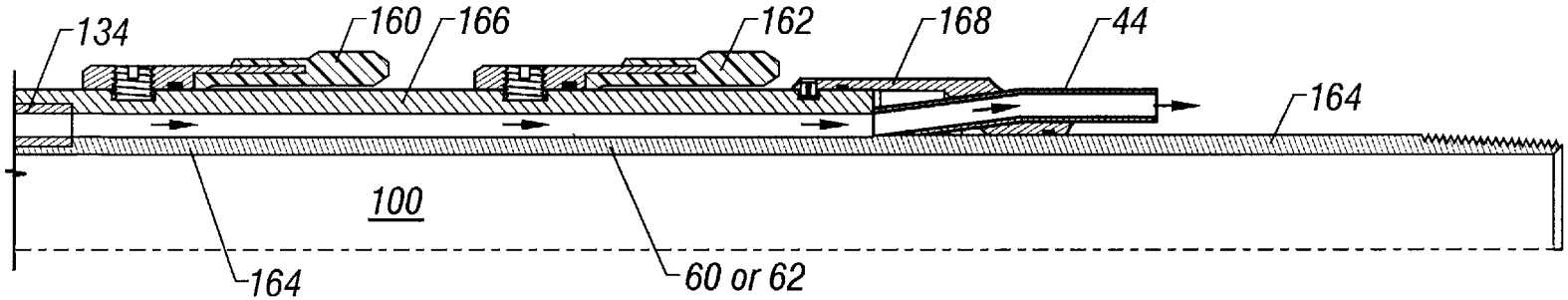

As shown in FIG. 2C, the lower end of the sub 134 is connected to a lower support housing 166 and a lower mandrel 164. The side conduit 60 or 62 continues to extend through the space between the lower support housing 166 and the lower mandrel 164. Casing cup packers 160 and 162 are attached to the lower support housing 166. The casing cup packers 160 and 162 are adapted to contact the inner wall of the casing 14 to provide a seal. A lower shunt locator mechanism 168 connects the side conduit 60 or 62 to the shunt tube 44 below the packer assembly 56 or 58. The lower end of the mandrel 164 is threadably connected to the next portion of the production tubing 12.

Figure 3A:
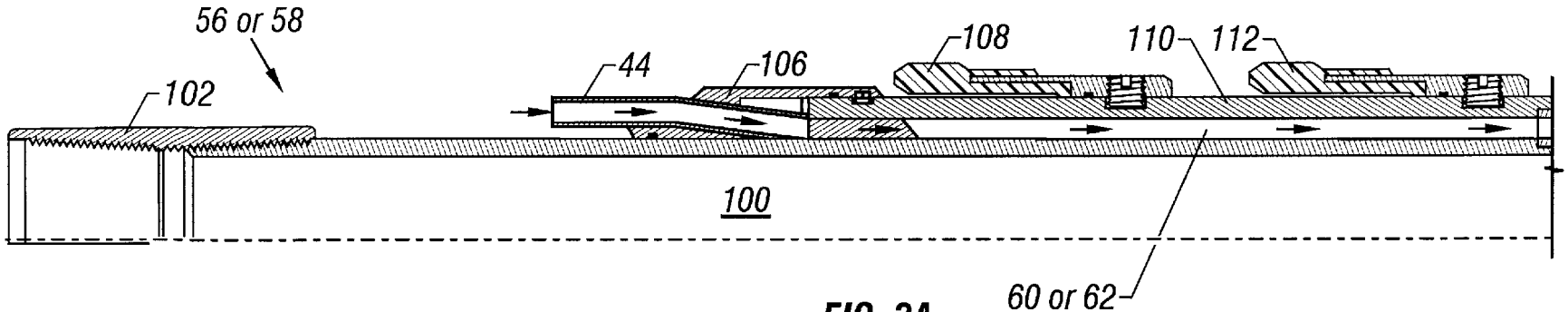
Figure 3B:
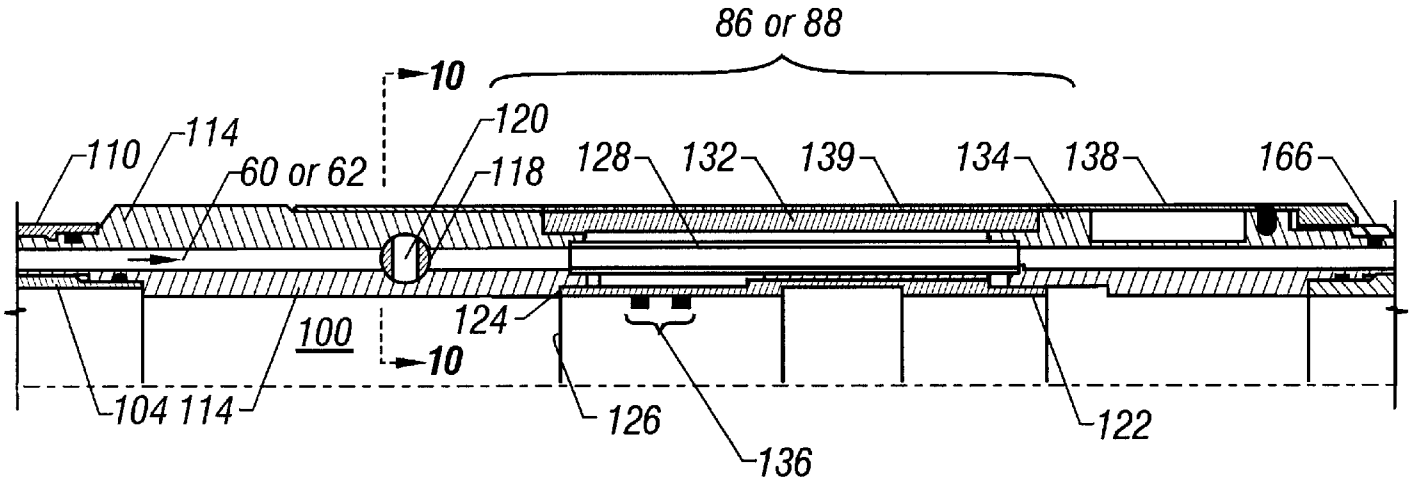
Figure 3C:
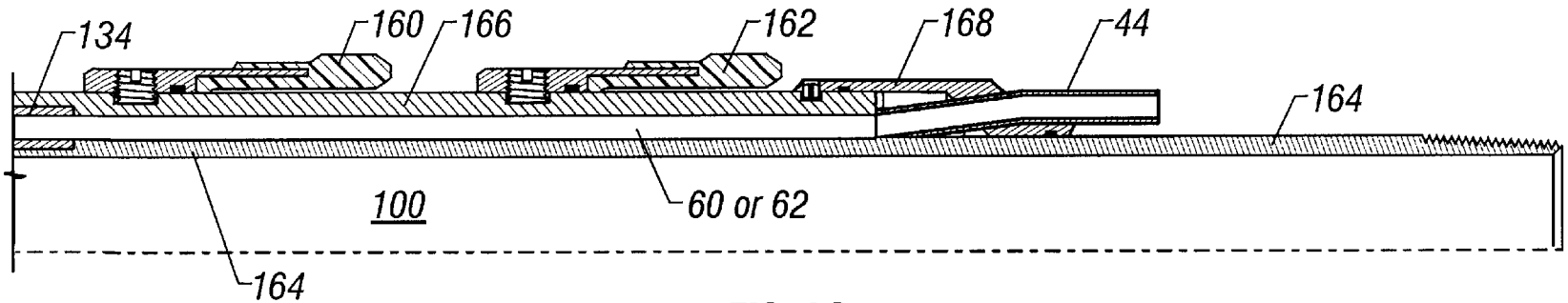
Figure 4A:
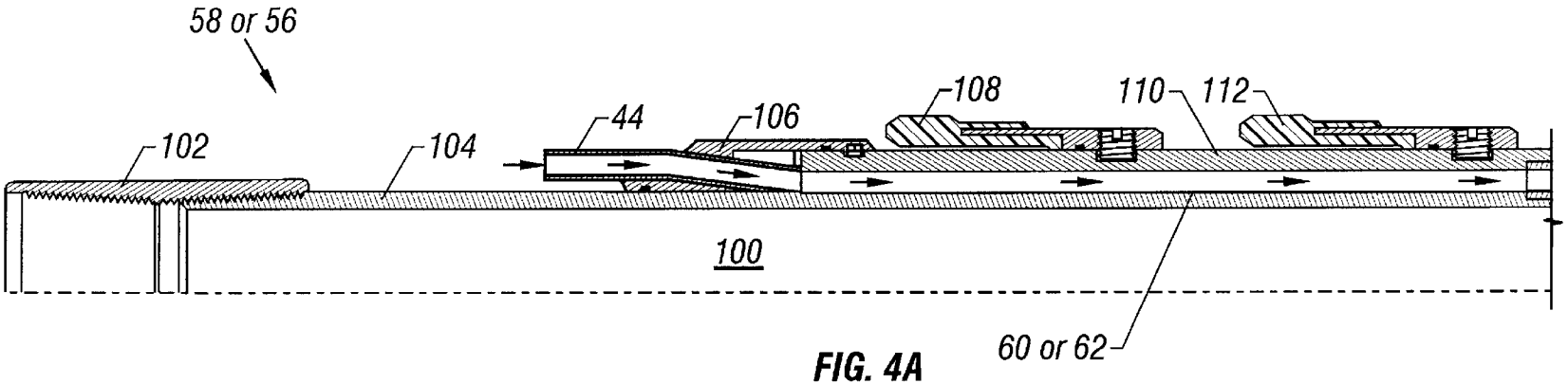
Figure 4B:
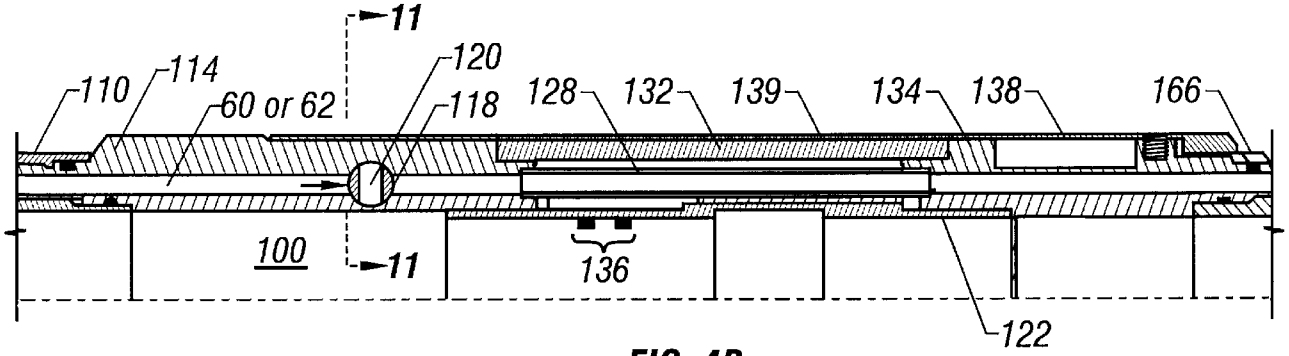
Figure 4C:
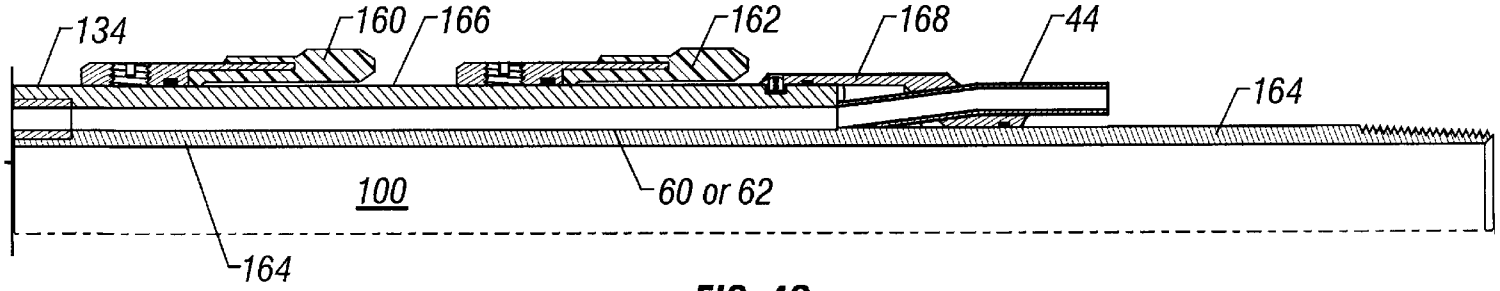
Figure 6:
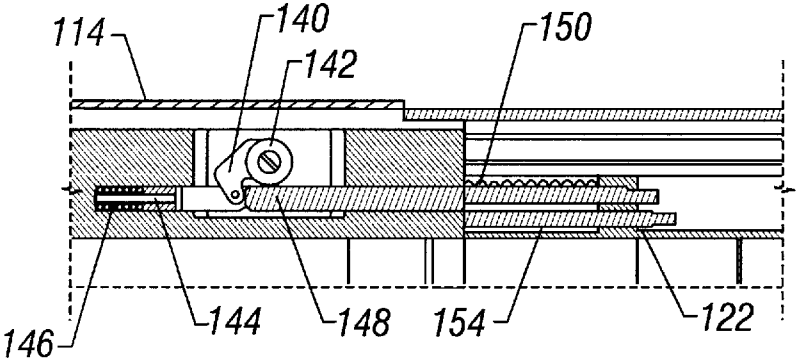
FIGS. 6 and 7 illustrate the flow control device actuator of FIGS. 5A–5C in an actuated position.
Figure 7:
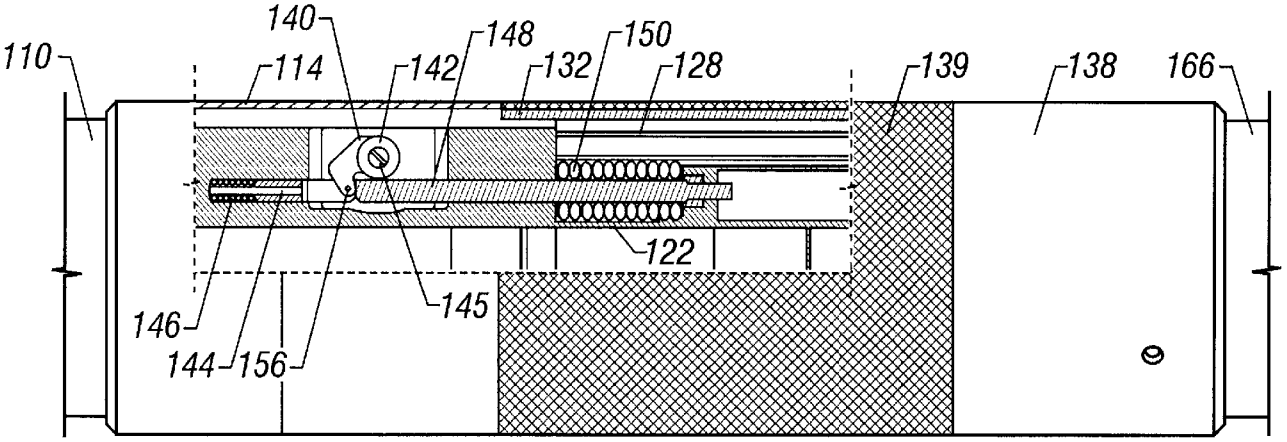

Referring to FIGS. 3A–3C, 6, and 7, the barrel valve 118 has been actuated to the closed position. As shown in FIGS. 3B and 7, the actuator sleeve 122 has been moved upwardly to its actuated position. The upward movement of the actuator sleeve 122 moves the rod member 148 and the control arm 140 to rotate the actuating ring 142 in the clockwise direction. Upward movements of the control rod 144 and rod member 148 compress respective spring 146 and spring 150. The rotation of the actuating ring 142 in the clockwise direction rotates the barrel valve 118 to its closed position, as illustrated in FIG. 3B. FIG. 6 shows another portion of the flow control device actuator 86 or 88 in a phase different from that of the portion shown in FIG. 7. A stop rod 154 is provided to stop further upward movement of the rod member 148 to prevent overload on the control arm pin 156 from force applied by the rod member 148.

Figure 8:
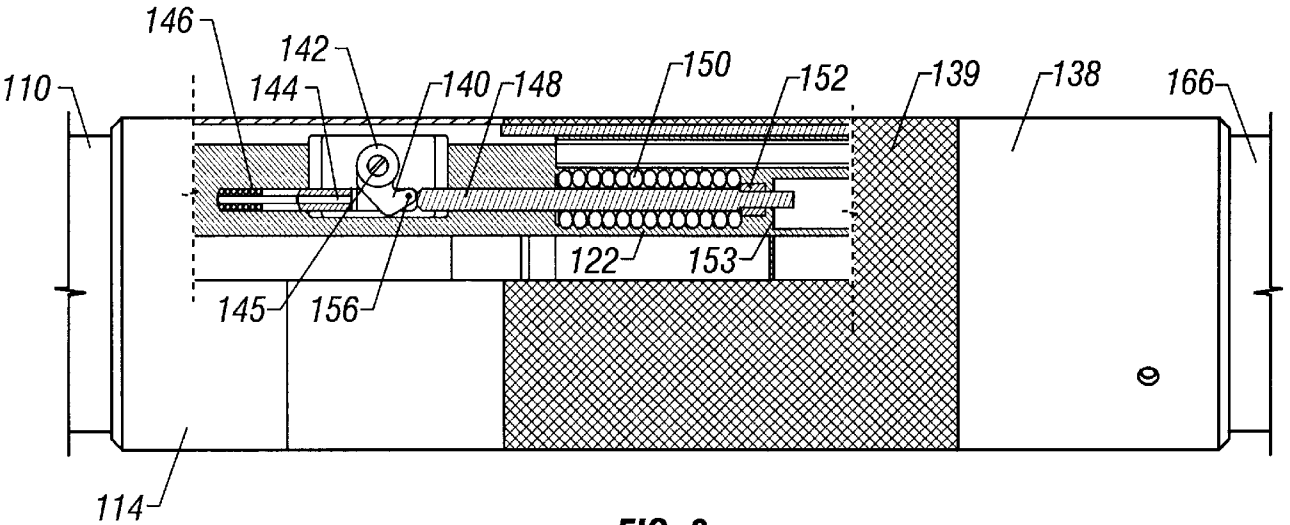
FIG. 8 illustrates the flow control device actuator of FIGS. 5A–5C in a recocked or relaxed position.

Referring to FIGS. 4A–4C and 8, after the barrel valve 118 has been actuated to its closed position, the actuating ring 142 is allowed to rotate back in the counterclockwise direction to its initial "recocked" or relaxed position, as shown in FIG. 8. The force applied by the springs 146 and 150 returns the control rod 144 and rod member 148 to their respective relaxed positions after the flow control device operator has disengaged the profile 136 of the actuator sleeve 122. The movement of the control rod 144 to its relaxed position pushes the control arm 140 downwardly, which in turn rotates the actuating ring 142 back to its initial position. A ratchet mechanism between the actuating ring 142 and the barrel valve 118 allows the valve to remain in its closed position even though the actuating ring 142 is rotating in the counterclockwise direction to its relaxed position. Thereafter, the actuator sleeve 122 may be re-actuated to open the barrel sleeve 118, using the same procedure discussed above.

Figure 9:
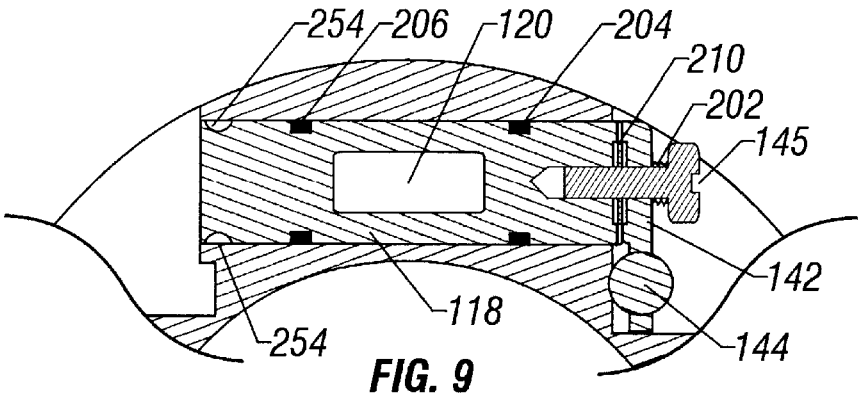
FIGS. 9–11 are cross-sectional views of a barrel valve in three different positions in the flow control device of FIGS. 2A–2C, 3A–3C, and 4A–4C.
Figure 10:
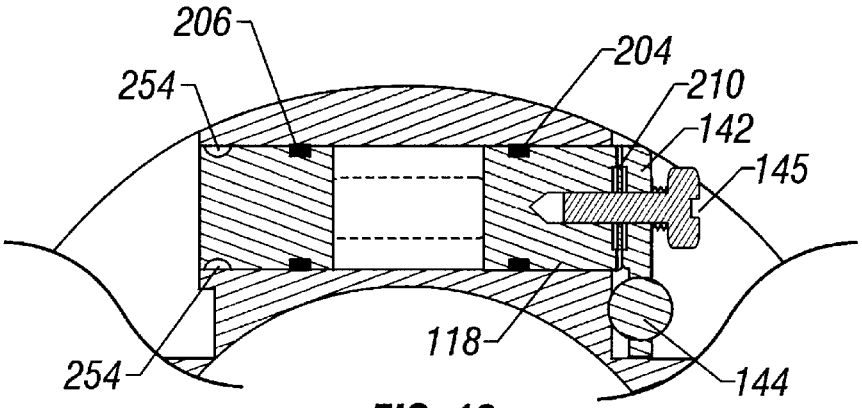
Figure 11:
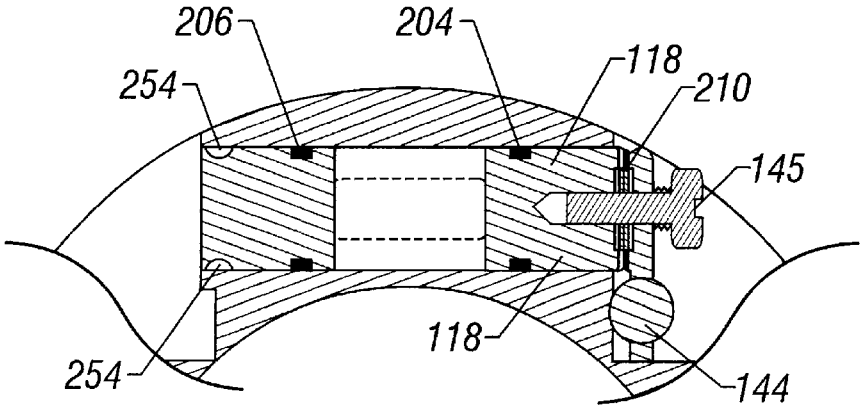

Referring to FIGS. 9, 10 and 11, the barrel valve 118 and actuating ring 142 are shown in three different positions, corresponding to the positions illustrated in FIGS. 2B, 5B; 3B, 7; and 4B, 8. In FIG. 9, the barrel valve 118 is in its open position. The actuating ring 142 is attached to the barrel valve 118 by a control arm screw 145. A spring 202 is held by the screw 145 to press the actuating ring 142 against a side of the barrel valve 118. Seals 204 and 206, which may be O-ring seals, are provided around portions of the barrel valve 118 to seal fluids passing through the conduit 120 of the barrel valve 118.

A ratchet mechanism 210 is positioned between the inner surface of the actuating ring 142 and a side of the barrel valve 118. The ratchet mechanism 210 allows the actuating ring 142 to engage the barrel valve 118 when the actuating ring 142 rotates in a first direction (e.g., clockwise). However, when the actuating ring 142 rotates in the opposite direction (e.g., counterclockwise), the ratchet mechanism 210 provides a path of lower resistance to allow the barrel valve 118 to remain in position even though the actuating ring 142 is rotating.

In FIG. 10, the barrel valve 118 has been rotated to its closed position by the actuating ring 142. In FIG. 11, the actuating ring 142 rotates back to its relaxed or recocked position in the counterclockwise direction without rotating the barrel valve 118.

Figure 12:
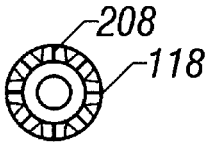
FIGS. 12–13 are cross-sectional views of a ratchet mechanism coupling an actuating member to the barrel valve of FIGS. 9–11.
Figure 13:
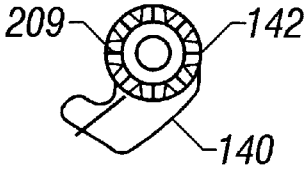

Referring to FIGS. 12 and 13, the ratchet mechanism 210 between the actuating ring 142 and the barrel valve 118 includes a first gear profile 208 on one side of the barrel valve 118 and a second gear profile 209 on the inside of the actuating ring 142. The gear profiles 208 and 209 are adapted to engage when the actuating ring rotates in the clockwise position but to not engage when the actuating ring 142 rotates back in the counterclockwise direction.

Figure 14:
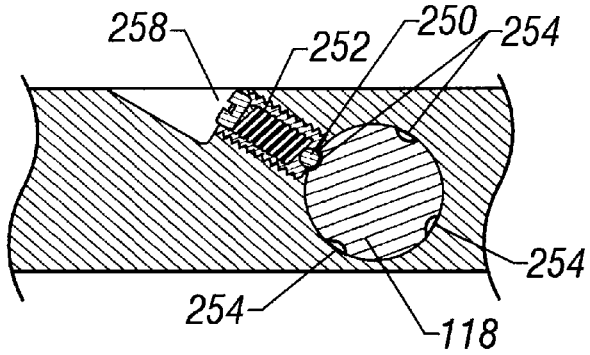
FIGS. 14–16 illustrate a lock mechanism that holds the barrel valve in position.
Figure 15:
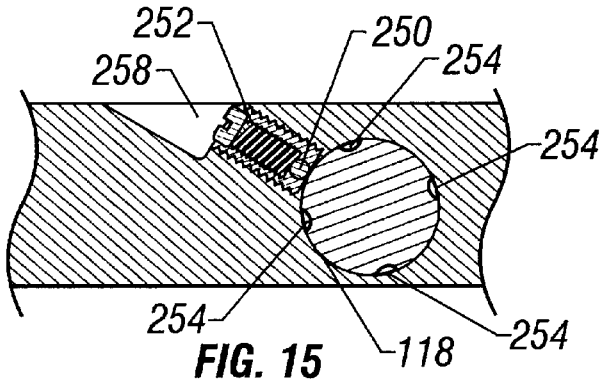
Figure 16:
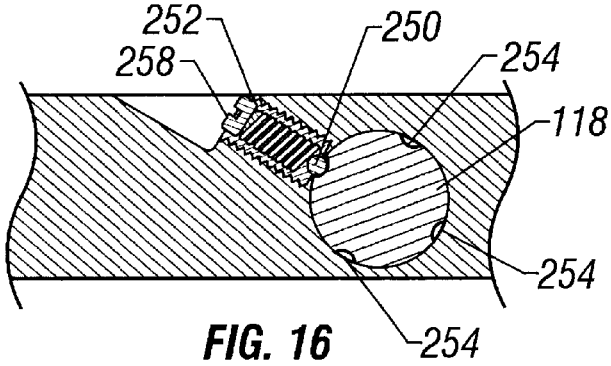

Referring to FIGS. 14, 15 and 16, a valve locking mechanism is illustrated that includes a ball 250 that is pushed against the surface of the barrel valve 118 by a spring 252. Grooves 254 are formed in the outer surface of the barrel valve 118 to receive the locking ball 250. The force applied by the spring 252 against the locking ball 250 allows the barrel valve 118 to remain in position while the ratchet mechanism 210 is ratcheting back to its relaxed or recocked position. In the illustrated embodiment, four locking grooves 254 are provided that are about 90° apart. Each locking groove 254 corresponds to a position (open or closed) of the barrel valve 118.

In FIG. 14, the barrel valve 118 is in a first position. When the barrel valve 118 is rotated by the actuating ring 142 to the next position, the locking ball 250 is pushed away from the groove 254 onto the outer surface of the barrel valve 118, as illustrated in FIG. 15. The barrel valve 118 is rotated by about 90 degrees to its next position, where the locking ball 250 is received by the next locking groove 254 in the barrel valve 118.

A pressure release mechanism 258 is provided adjacent the spring 252 to release pressure in case of pressure buildup in the space in which the spring 252 is located. This prevents high pressure from locking the barrel valve 118 in either an open position or a closed position.

In operation, according to one example, the packer assemblies 56 and 58 may be run in with respective barrel valves 118 in the open position. After the packer assemblies are set at desired intervals, gravel slurry may be pumped into the wellbore to perform gravel packing. The gravel slurry enters the shunt tubes 44 and is passed through each packer assembly 56 or 58 through the side conduits 60 or 62, respectively, as the annular region 50, 52, and 54 fill up with gravel. Communication through the side conduits 60 or 62 is possible while the barrel valve 118 remains in its opened position. After the gravel packing operation has completed, a flow control device operator, which may be located in the service tool 80, is moved upwardly to engage, in each packer assembly 56 or 58, the profile 136 (FIG. 2B) of the actuator sleeve 122 to move the actuator sleeve 122 upwardly. This causes the barrel valve 118 to close, as illustrated in FIG. 3B. As a result, further fluid communication through each side conduit 60 or 62 between different zones is shut off. When the flow control device operator is further moved upwardly, the operator is disengaged from the latch profile 136 of the actuator sleeve 122, which allows springs 146 and 150 to push the control rod 144 and actuating ring 142 back to their initial, relaxed positions. This allows re-actuation of the barrel valve 118 if desired.

In accordance to further embodiments, other arrangements of the flow control devices may be used. For example, flow control devices may be placed at strategic locations along each alternate path conduit to control fluid communication between various portions of a wellbore. Some of the flow control devices may be run into the wellbore in the open position, while others are run into the wellbore in the closed position. After predetermined tasks are performed, some of the flow control devices may be actuated open while others closed. In further embodiments, a flow control device actuator may be operatively coupled to more than one flow control device so that the actuator can actuate multiple flow control devices at the same time.

In other embodiments, different forms of actuators may be used to operate the barrel valves. For example, a hydraulic or electrical actuating system may be used. Further, different types of valves may be used in the side conduits, such as ball valves, sleeve valves, flapper valves, and so forth.

A completion string has been described that includes a main conduit, such as production tubing, and one or more alternate path conduits, such as shunt tubes and side conduits in packer assemblies. Flow control devices are placed in each alternate path conduit to control fluid flow. The flow control devices may be adjustable between at least an open position and a closed position. If desired, each flow control device may also be adjusted to an intermediate choke position. In one application, the alternate path conduits are used to carry gravel slurry during gravel packing operations. After desired portions of the well have been packed with gravel, the flow control devices may be actuated from the open position to the closed position to block fluid communication through the alternate path conduits. This avoids or reduces commingling of fluids between different portions or zones in the well.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. An apparatus for use in a wellbore, comprising:

a main conduit;

a plurality of shunt conduits; and a plurality of flow control devices positioned in corresponding shunt conduits to control flow through the shunt conduits.

2. The apparatus of claim 1, wherein each shunt conduit includes a shunt tube.

3. An apparatus for use in a wellbore, comprising:

a main conduit;

a shunt conduit;

a flow control device positioned in the shunt conduit to control flow through the shunt conduit, wherein the shunt conduit extends between at least two zones in the wellbore, the flow control device adapted to be actuated to a closed position to block fluid communication between the two zones through the shunt conduit, and wherein the shunt conduit includes a shunt tube having at least one side port in fluid communication with at least one of the zones.

4. The apparatus of claim 3, wherein the shunt tube is adapted to carry gravel slurry to each of the at least two zones.

5. The apparatus of claim 3 further comprising a packer assembly including the main conduit and the shunt conduit.

6. The apparatus of claim 3, wherein the flow control device includes a valve actuatable between at least an open position and a closed position.

7. The apparatus of claim 6, wherein the valve includes a barrel valve.

8. The apparatus of claim 3, wherein the main conduit includes a production tubing.

9. Add The apparatus of claim 8, wherein the shunt conduit is attached to the production tubing.

10. The apparatus of claim 3, further comprising at least one other shunt tube.

11. The apparatus of claim 3, wherein the shunt tube has a plurality of ports in communication with at least one of the zones.

12. The apparatus of claim 3, wherein the shunt tube is adapted to extend to a location above the at least two zones.

13. The apparatus of claim 3, wherein the shunt tube is adapted to carry fluid from above the at least two zones to the at least two zones if the flow control device is open.

14. A method of controlling fluid communication in a wellbore, comprising:

providing a main conduit and a shunt conduit, the shunt conduit having ports to plural zones in the wellbore;

providing a flow control device in the shunt conduit;

actuating the flow control device between at least an open and a closed position to control fluid flow in the shunt conduit;

opening the flow control device to enable communication of fluid through the shunt conduit and out the ports to the zones; and closing the flow control device to prevent communication between zones.

15. The method of claim 14, further comprising providing at least one other shunt conduit and one other flow control device.

16. The method of claim 14, further comprising flowing production fluid through the main conduit and flowing another type of fluid through the shunt conduit.

17. The method of claim 16, wherein flowing the other type of fluid includes flowing a fluid containing gravel slurry.

18. The method of claim 16, wherein flowing the other type of fluid includes flowing a fracturing fluid.

19. The method of claim 14, wherein actuating the flow control device includes actuating a barrel valve.

20. The method of claim 14, wherein providing the shunt conduit comprises extending the shunt conduit from above the plural zones to each of the plural zones.

21. A completion string for use in a wellbore, comprising:

a tubing;

a packer attached to the tubing to divide the wellbore into a first zone and a second zone;

a shunt conduit next to the tubing, the shunt conduit having at least a first side port to communicate with the first zone and at least a second side port to communicate with the second zone, the shunt tube adapted to carry fluid for communication through the first and second side ports to respective first and second zones; and a flow control device in the shunt conduit to control flow through the shunt conduit, the flow control device adapted to be opened to communicate the fluid to the first and second zones from the shunt conduit, and the flow control device adapted to be closed to prevent communication between the zones.

22. The completion string of claim 21, further comprising at least another shunt conduit.

23. The completion string of claim 21, wherein the shunt conduit includes a shunt tube.

24. The completion string of claim 21, wherein the shunt conduit is adapted to extend from above the first and second zones to each of the first and second zones.

25. The completion string of claim 21, wherein the packer includes a first conduit in communication with the tubing and a second conduit in communication with the shunt conduit.

26. The completion string of claim 21, further comprising at least one other packer attached to the tubing and isolating a third zone, wherein the shunt conduit extends to the first, second, and third zones.

27. The completion string of claim 26, further comprising at least another flow control device to control flow through the shunt conduit between the second and third zones.

28. The completion string of claim 21, wherein the shunt conduit is adapted to carry gravel slurry to gravel pack the first and second zones.

29. The completion string of claim 21, wherein the shunt conduit is adapted to carry fracturing fluid to fracture formation proximal the first and second zones.

30. An apparatus for use in a wellbore, comprising:

a production tubing;

a plurality of shunt conduits; and a packer assembly including a first conduit in communication with the production tubing and a plurality of second conduits in communication with the shunt conduits, the packer assembly further including flow control devices in corresponding shunt conduits, each flow control device actuatable between at least an open position and a closed position.

31. The apparatus of claim 30, wherein the shunt conduits comprise shunt tubes.

32. The apparatus of claim 30, wherein each shunt conduit has at least one port communicating with a respective one of the plural zones isolated by the packer assembly.

33. The apparatus of claim 32, wherein each shunt conduit is adapted to carry one of gravel slurry and fracturing fluid to communicate through the ports to the zones.

34. An apparatus for use in a wellbore, comprising:

a main conduit;

a shunt tube; and a flow control device in the shunt tube to control flow through the shunt tube.

35. The apparatus of claim 34, further comprising at least one other shunt tube and one other flow control device in the one other shunt tube.

36. The apparatus of claim 34, wherein the shunt tube has an inlet and at least one side port.

37. The apparatus of claim 36, wherein the shunt tube has a plurality of side ports.

38. The apparatus of claim 37, wherein the wellbore has plural zones, and wherein the plurality of side ports are adapted to communicate with the plural zones.

39. An apparatus for use in a wellbore having plural zones, comprising:

a main conduit;

an alternate path conduit, the alternate path conduit having plural side ports to communicate fluid from the alternate path conduit to at least two of the plural zones; and a flow control device in the alternate path conduit to control fluid flow in the alternate path conduit.

40. The apparatus of claim 39, wherein the alternate path conduit has an inlet to receive gravel slurry, the alternate path conduit adapted to deliver the gravel slurry through the side ports to the at least two of the plural zones.

41. A method of gravel packing a zone in a wellbore, comprising:

providing a shunt conduit extending beside a main conduit, the shunt conduit extending to the zone;

injecting a gravel slurry into the shunt conduit; and actuating a flow control device in the shunt conduit to control flow of the gravel slurry through the shunt conduit to the zone.

42. The method of claim 41, wherein providing the shunt conduit comprises providing a shunt tube.

43. The method of claim 41, further comprising the shunt conduit to at least one other zone in the wellbore to flow gravel slurry to the one other zone.

44. The method of claim 43, further comprising providing plural side ports to communicate the gravel slurry from inside the shunt conduit to the plural zones.

45. An apparatus for use in a wellbore, comprising:

a main conduit;

a shunt conduit;

a flow control device positioned in the shunt conduit to control flow through the shunt conduit, wherein the flow control device includes a barrel valve actuatable between at least an open position and a closed position; and an actuating member and a ratchet mechanism coupling the actuating member to the barrel valve.

46. The apparatus of claim 45, wherein the actuating member engages the barrel valve when moving in a first direction.

47. The apparatus of claim 46, wherein the ratchet mechanism allows the actuating member to return to a second position without moving the barrel valve.

* * * * *